United States Patent [19]

Yamanaka et al.

[11] Patent Number: 4,983,231

[45] Date of Patent: Jan. 8, 1991

[54] COATED MAGNETIC POWDER AND A BONDED PERMANENT MAGNET COMPOSITION CONTAINING THE SAME

[75] Inventors: Hiroshi Yamanaka; Yasuhiro Nakamura, both of Higashiosaka, Japan

[73] Assignee: Daihachi Chemical Industry Co., Ltd., Osaka, Japan

[21] Appl. No.: 353,497

[22] Filed: May 18, 1989

[30] Foreign Application Priority Data

May 25, 1988 [JP] Japan ..... 63-128728

[51] Int. Cl.[5] ..... H01F 1/04

[52] U.S. Cl. ..... 148/301; 148/302; 75/230; 75/244; 252/62.53; 252/62.54; 428/404; 428/405; 427/127

[58] Field of Search ..... 75/251, 230, 244; 148/301, 302; 428/404, 405; 252/62.53, 62.54

[56] References Cited

U.S. PATENT DOCUMENTS 4,336,310 6/1982 Okuyama et al. ..... 428/404

4,475,946 10/1984 Matsufuji et al. ..... 75/0.5 AA

FOREIGN PATENT DOCUMENTS 125752 11/1984 European Pat. Off. .

59-211549 11/1984 Japan .

62-152107 7/1987 Japan .

*Primary Examiner*—John P. Sheehan

*Attorney, Agent, or Firm*—Spencer & Frank

[57] ABSTRACT

There is provided a surface-treated magnetic powder that can form a resin-bonded permanent magnet with large magnetic force and a high maximum energy product, which magnetic properties do not decrease even after the long periods of time. The surface-treated magnetic powder is obtained by treating a magnetic powder made of an alloy that comprises a rare earth metal and iron with a treatment agent containing a alkali-modified silica particles as a major component, wherein the alkali-modified silica particles are obtained by reacting silica particles with a mean particle diameter of from 0.005 to 0.1 μm with an alkali to modify only the surface portion of the silica particles by the alkali.

11 Claims, No Drawings

COATED MAGNETIC POWDER AND A BONDED PERMANENT MAGNET COMPOSITION CONTAINING THE SAME

BACKGROUND OF THE INVENTION

1. Field of the Invention

This invention relates to a surface-treated magnetic powder with excellent oxidation resistance and excellent moisture resistance, and is also relates to a resin-bonded permanent magnet composition containing the same.

2. Description of the Prior Art

With rapid technological development in the field of electronics, electric household appliances and electronic equipment such as office automation equipment have been made miniature, light, and thin for the purpose of saving energy and resources. For smaller electric household appliances and electronic equipments, various parts used therein must be made smaller. For example, a motor used for a tape recorder of small size requires a small permanent magnet with excellent magnetic properties. In general, such a magnet must have a complicated form with precise dimensions.

However, conventional permanent magnets such as sintered magnets and cast magnets are not appropriate for use in smaller devices because their mechanical properties such as impact resistance and tensile strength are poor, as is their workability. Therefore, a resin-bonded permanent magnet (a so-called plastic magnet) obtained by the molding of a magnetic powder with a resin binder has been developed. Resin-bonded permanent magnets can be obtained easily by conventional molding methods. Also, a small permanent magnet with relatively large magnetic force can be obtained by selection of an appropriate magnetic powder. Molding materials (i.e., magnetic powders and binders), molding machines, technique to disperse magnetic powders into binders, and filling techniques of molding materials into molding machines have been improved recently, and the effective use and consumption of resin-bonded permanent magnets have therefore increased.

For the preparation of resin-bonded permanent magnets, ferrite-type or alnico-type magnetic materials have been usually used. However, in recent years, magnetic materials with an extremely high maximum energy product (for example, samarium-cobalt alloys) have been developed and are used widely to prepare small resin-bonded permanent magnets with relatively large magnetic force.

However, magnetic material of a samarium-cobalt alloy is very susceptible to oxidation, so it is in danger of burning during molding if not treated appropriately. Further, samarium, one of the components of this magnetic material, is usually found in only very small amounts among the rare earth metals in ore. Thus, the amount of samarium supplied depends upon the demand for other rare earth metals that are contained in the ore. It is expensive to separate and purify samarium. Cobalt also is expensive, and its supply is not steady because it is a strategic material.

In such circumstances, attempts to develop alternative magnetic materials that have a large magnetic force and that can be produced at a low price have been made. For example, Japanese Laid-Open Patent Publication No. 59-211549 discloses a magnetic material of the neodymium-iron-boron type that has extremely large magnetic force. This magnetic material can be obtained at low price because it contains a large amount of iron, which is widely available.

However, this type of magnetic material is also readily oxidized although it is less susceptible to oxidation than magnetic materials of the samarium-cobalt type. Further, because its major component is iron, the magnetic material will be corroded and rust in the presence of water. For example, when a resin-bonded permanent magnet prepared by the molding of this powdered magnetic material with a binder is used under the circumstances of relatively high humidity, rust will form on the surface of the magnet material and on the internal surfaces of the small spaces that are present in the magnet. As a result of the generation of rust, the magnetic force of the resin-bonded permanent magnet will decrease greatly with time. Moreover, rust inside the magnet will destroy the magnet itself. Thus, when a resin-bonded permanent magnet is used as a part of a motor, normal operation cannot be achieved because of rust.

To solve these problems, it has been proposed that the surface of such a powdered magnetic material be treated with phosphoric acid, chromic acid, etc., which are well known rust preventing agents for iron. However, because iron that is present near the surface of the magnetic powder will react with phosphoric acid or chromic acid, which changes the composition of the magnetic material of the powder a resin-bonded permanent magnet with large magnetic force cannot be prepared from the magnetic material. Further, because the magnetic powder retains the anti-rusting effect of treatment for only a short time, an additional resin layer must be formed on its surface in order to provide sufficient anti-rusting effect, which leads to several disadvantages such as poor magnetic properties, higher price, etc.

Japanese Laid-Open Patent Publication No. 62-152107 discloses a magnetic powder for a resin-bonded magnet, prepared by the formation of a layer of silicic acid anhydride or a silicate on the surfaces of a magnetic powder of the samarium-cobalt type to protect the powder from oxidation. The formation of the layer will improve its oxidation resistance. However, the layer of silicic acid anhydride has fine pinholes through which the magnetic powder is exposed to the air. When the magnetic powder with the coated layer is used under the circumstances of high humidity, some of the layer will dissolved into water because of its water solubility, so that the magnetic powder comes into contact with the water in the air directly. Therefore, the coated layer of silicic acid anhydride or silicate does not provide a magnetic powder with satisfactory anti-rusting properties.

To prevent rusting, an attempt has also been made to coat the surface of resin-bonded permanent magnets with a rust preventing agent or a resin. However, the resin-bonded permanent magnet should be coated with a layer about 20 μm or more thick to provide satisfactory anti-rusting effects. The resulting resin-bonded permanent magnet with such a thick layer cannot, however, be used for precision parts with a complicated form.

SUMMARY OF THE INVENTION

A surface-treated magnetic powder of this invention, which overcomes the above-mentioned and numerous disadvantages and deficiencies of the prior art, is obtained by treating a magnetic powder made of an alloy that comprises a rare earth metal and iron with a treatment agent that has alkali-modified silica particles as a major component, wherein said alkali-modified silica particles are obtained by reacting silica particles with a mean particle diameter of from 0.005 to 0.1 μm with an alkali to modify only the surface portion of said silica particles by said alkali.

A resin-bonded permanent magnet composition of this invention comprises the surface-treated magnetic powder and a binder.

In a preferred embodiment, the untreated magnetic powder contains as a major component an alloy of the formula RxTyBz: wherein R is at least one rare earth metal selected from the group consisting of neodymium, praseodymium, and misch metal; T is iron, or a combination of iron and iron-group elements; B is boron; x, y, and z denote atomic percents of R, T, and B, respectively, and satisfy the relationships:

$$8 \leqq x \leqq 30,\ 2 \leqq z \leqq 20,\ y = 100 - x - z$$

In a preferred embodiment, the alkali is potassium hydroxide.

Thus, the invention described herein makes possible the objectives of (1) providing a surface-treated magnetic powder for a resin-bonded permanent magnet with large magnetic force and a large maximum energy product, the magnetic properties of which do not decrease with time; (2) providing a surface-treated magnetic powder for a resin-bonded permanent magnet with excellent oxidation resistance and excellent moisture resistance, which magnet is stable without degradation during and after molding of the resin-bonded permanent magnet, by treating the surface of a magnetic material of the neodymium-iron-boron type by an appropriate means; and (3) providing a resin-bonded permanent magnet composition containing the abovementioned magnetic powder, from which a resin-bonded permanent magnet can be prepared at a low cost, with excellent magnetic properties, excellent oxidation resistance, excellent moisture resistance, and high stability even after long periods of time.

DESCRIPTION OF THE PREFERRED EMBODIMENTS

As the material of the magnetic powder used in the surface-treated magnetic powder of the present invention, an alloy comprising rare earth metals and iron that can be endowed with large magnetic force, preferably an alloy of the formula RxTYBz, can be used. In the above-mentioned formula, R is at least one rare earth metal selected from the group consisting of neodymium, praseodymium, and misch metal; T is iron, or a combination of iron and iron-group elements; B is boron; x, y, and z denote atomic percentages of R, T, and B, respectively, and satisfy the relationships:

$$8 \leqq x \leqq 30,\ 2 \leqq z \leqq 20,\ y = 100 - x - z$$

As used herein, the term "misch metal"means a mixture with rare earth metals of the cerium group, which can be obtained during smelting done to isolate neodymium and praseodymium from an ore, as major components. T is iron, or a mixture comprising a large amount of iron and relatively small amount of iron-group metals such as cobalt and nickel. In particular, the addition of a small amount of cobalt or nickel will increase the Curie temperature of the magnetic powder. Also, at least one metal selected from the group consisting of dysprosium (Dy), terbium (Tb), zirconium (Zr), hafnium (Hf), and the like can be included in the magnetic powder. When the numerical values of x, y, or z, or some combination, deviate from the range described in the above-mentioned relationships, the magnetic force of the resulting surface-treated magnetic powder is relatively small.

The mean particle diameter of the silica particles used in this invention is in the range of from 0.005 to 0.1 μm, and preferably from 0.01 to 0.05 μm. The silica particles can include ultrafine particles of silica, colloidal silica, etc. The ultrafine particles of silica include white carbon and ultrafine particles of anhydrous silica. The white carbon is prepared from sodium silicate by the wet method. The ultrafine particles of anhydrous silica are prepared from silicon halide by the dry method. The colloidal silica is a colloid obtained by the dispersal of ultrafine particles of silicic acid anhydride into water. Any of the kinds of colloidal silica (silica sol) that are commercially available can be used in this invention. Also, a mixture of two or more kinds of such silica particles can be used. The silica particles are used at the proportion of from 3 to 4.5 moles, and preferably from 3.5 to 4.2 moles, on the basis of $SiO_2$ per mole of the alkali mentioned below. When MOH, $M_2CO_3$, etc., is used as the alkali (wherein M is alkaline metal such as K, Na, Li, or the like), the moles of these alkalis are those of the corresponding alkalis of the formula $M_2O$. For example, as two moles of KOH corresponds to one mole of $K_2O$, this amount is regarded as being one mole of alkali. When an excess of silica particles is used in comparison with the alkali, a uniformly treated layer with adequate water resistance cannot be formed on the surface of the particles. When a smaller amount of the silica particles is used, the particles are dissolved into the alkali to form a solution of alkali silicate. Thus, the treated magnetic powder that is obtained has an alkali silicate-coated layer, resulting in, poor water resistance.

The alkalis that can be used include alkali hydroxides, alkali carbonates, etc. Alkali hydroxides include potassium hydroxide, lithium hydroxide, sodium hydroxide, and the like. Alkali carbonates include potassium carbonate, lithium carbonate, sodium carbonate, and the like. When only one kind of alkali is used, potassium hydroxide is preferable. When lithium hydroxide is used alone, a uniformly treated layer with satisfactory adhesiveness is formed only with difficulty on the surface of a magnetic powder with the use of the treated silica particles obtained. When sodium hydroxide is used alone, the resulting surface-treated magnetic powder has poor water resistance. However, the combination of sodium hydroxide and other appropriate alkalis may provide a uniformly treated layer with high adhesiveness to the magnetic powder, resulting in a surface-treated magnetic powder with excellent water resistance. Therefore, two or more of the alkalis can be used.

A treatment agent for the preparation of a surface-treated magnetic powder of this invention contains as a major component alkali-modified silica particles, which are obtained by modification of silica particles with alkali. For example, alkali-modified silica particles can be obtained by preparation of an aqueous emulsion containing silica particles and the alkali at a constant ratio, and then by heating of the emulsion at the temperature of from 90° to 100° C. for 1 to 10 hours, and preferably for about 2 hours. The temperature and the heating time depend on the mean particle size of the silica particles and on the molar ratio of the silica particles to the alkali. The resulting silica particles have an alkali-modified portion only at their outer surfaces. The percentage of the modified portion of each silica particle ranges from about 10 to 50% on the basis of its particle diameter, and the remaining portion of the silica particles retain their original composition.

The treatment agent mentioned above optionally contains a curing agent to improve the water resistance of the resulting surface-treated magnetic powder. Examples of curing agents include inorganic acids such as hydrochloric acid, phosphoric acid, sulfuric acid, nitric acid, boric acid, and the like; metal oxides such as zinc oxide, magnesium oxide, calcium oxide, and the like; metal hydroxides such as calcium hydroxide, magnesium hydroxide, zinc hydroxide, and the like; silicon compounds such as sodium silicofluoride, potassium silicofluoride, calcium silicofluoride, and the like; inorganic salts such as sodium aluminate, sodium hydrogensulfate, magnesium sulfate, sodium hydrogencarbonate, and the like; metal fluorides such as sodium fluoride, potassium fluoride, and the like; borates such as potassium borate, calcium borate, and the like; ethylene carbonate; γ-butyrolactone; glyoxal; and ethylene glycol diacetate. A curing agent mentioned above is added to an emulsion containing the alkali-modified silica particles to obtain a treatment agent.

This treatment agent is used at the proportion of from 0.1 to 5 parts by weight, and preferably from 0.2 to 0.8 parts by weight, calculated as the weight of the alkali-modified silica particles, per 100 parts by weight of the magnetic powder mentioned above. When a smaller amount of the treatment agent is used, the surface-treated magnetic powder obtained does not have sufficient oxidation resistance or rust resistance. When an excess of the treatment agent is used, the anti-oxidation and anti-rusting properties of the resulting surface-treated magnetic powder do not increase in proportion to the amount of the treatment agent added. Moreover, because the surface-treated magnetic powder has a thick coat of the treatment agent, resin-bonded permanent magnets prepared from the magnetic powder will not have large magnetic force because of the relatively small amount of magnetic component contained.

A resin-bonded permanent magnet composition of this invention comprises the surface-treated magnetic powder mentioned above and a binder. Examples of the binder include thermosetting and thermoplastic resins. The thermosetting resins include phenol resins, epoxy resins, silicon resins, and the like. The thermoplastic resins include polyethylene, polypropylene, polystyrene, polyvinyl chloride, polyamide, polyacetal, polyphenylene sulfide, polysulfone, polyether sulfone, polyethylene terephthalate, polybutylene terephthalate, polycarbonate, and the like. Liquid-crystal polymers also are included. The thermosetting resin is included in the proportion of from 2 to 10% by weight, and preferably about 3% by weight, in the composition. On the other hand, the thermoplastic resin is included in the proportion of from 5 to 20% by weight, and preferably about 10% by weight, in the composition. Smaller amounts of the binder used reduce the workability of the resulting composition, whereas an excess amount of the binder used gives the composition weak magnetic force.

The magnetic powder used for preparation of the surface-treated magnetic powder of this invention can be obtained by various conventional methods with the use of the desired metals. For example, a magnetic powder that is an isotropic magnetic powder can be prepared by the following procedure. An ingot is made by melting a composition of metals such as neodymium, iron, and boron, and optionally cobalt, nickel, etc., at a suitable rate. Then the ingot is melted again in a quartz tube and formed into a ribbon by the melt-spinning method. That is, the melted ingot in the quartz tube is sprayed onto the surface of a rotating quenching drum by the pressure of argon gas, and the melted ingot is rapidly cooled to form a ribbon. The ribbon is ground under an argon gas atmosphere to obtain a magnetic powder. The mean particle diameter of the magnetic powder obtained is generally adjusted to a range of from 20 to 200 μm. A magnetic powder with a smaller mean particle size does not retain sufficient magnetic force therein, whereas magnetic powders with a larger mean particle size cannot be easily molded.

A surface-treated magnetic powder of this invention is obtained by mixing the magnetic powder mentioned above with a treatment agent dispersion containing as a major component the alkali-modified silica particles mentioned above, and then by heat-drying of the mixture at the temperature of from 100° to 250° C., and preferably from 150° to 180° C. Various mixing methods can be used to prepare the surface-treated magnetic powder. In a method for obtaining a surface-treated magnet powder, the ribbon mentioned above is ground in a dispersion of the treatment agent, the mixture is heat-dried. The resulting magnetic powder can be treated with a silane coupling agent, titan coupling agent, treatment agent of the phosphoric acid type, and the like to improve its adhesiveness to a resin binder during the molding process described below.

A composition of this invention containing the resulting surface-treated magnetic powder and the binder mentioned above is molded by various conventional molding methods such as compression molding, transfer molding, extrusion molding, injection molding, and the like to form a resin-bonded permanent magnet.

According to the present invention, a surface-treated (i.e., coated) magnetic powder of which the surface is treated and modified by a treatment agent containing alkali-modified silica particles as a major component can be obtained. As described above, the alkali-modified silica particles are modified only at their outer surfaces to form alkali silicate. The surface of the magnetic powder is coated with the alkali-modified silica particles by its treatment with the treatment agent containing the particles. When the coated magnetic powder is heated at the temperature of from 100° to 250° C., the alkali silicate that is present on the surface of the magnetic powder is condensed and dehydrated to form polysiloxane. The polysiloxane causes the silica particles to adhere and bind to each other. Also, the polysiloxane helps the silica particles to adhere tightly to the surface of the magnetic powder. As result, the surface of the surface-treated magnetic powder obtained is coated completely with the silica particles without pinholes, and the silica particles adhere tightly to each other via the polysiloxane. Thus, as the surface-treated magnetic powder is excellent in oxidation resistance and water resistance, rust does not form under the circumstances of high humidity. Also, this magnetic powder is excellent in its resistance to heat, ultraviolet rays, radioactive rays, friction, oil, organic solvents, etc.

The surface-treated magnetic powder has a very thin coated layer formed on its surface that contains the alkali-modified silica particles mentioned above. The thickness of the layer is normally from 0.01 to 0.1 μm, depending on the mean particle diameter of the magnetic powder used. The extremely thin coated layer mentioned above does not affect the magnetic properties of the magnetic powder itself, so that the resulting surface-treated magnetic powder may retain a large magnetic force. The surface-treated magnetic powder has excellent oxidation resistance, so it has the following several advantages. When the magnetic powder is stored, it does not require storage with the expensive inert gas that is usually used to prevent oxidation. When the magnetic powder is molded to form a resin-bonded permanent magnet, ignition because of oxidation does not occur if the powder comes into contact with air at high temperatures. Thus, the magnetic powder is not as dangerous to handle. When a mixture containing the magnetic powder and a resin binder is molded by means of injection molding, the mixture that remains in the sprue and runner of the molding machine can be used again because it is not oxidized, which is economical. The resin-bonded permanent magnet prepared from the surface-treated magnetic powder of this invention does not become rusty, and has stable magnetic properties. Thus, the resin-bonded permanent magnet has a long life-span.

EXAMPLE 1

(A) Preparation of surface-treated magnetic powder

First, four 50 g portions of Magnequench ($Nd_2Fe_{17}B$, General Motors Corp.) were put into four 100 ml beakers. Ten percent by weight of aqueous emulsions of the treatment agents (a–d in Table 1) containing silica particles and alkalis at the molar ratio shown in Table 1 were prepared by addition of silica particles and alkalis into water and then heating of the mixture to temperatures between 90° and 100° C. for 2 hours. As the colloidal silica and ultrafine powder silica mentioned in Table 1, Snowtex O (Nissan Chemical Corp.) and Nipsil E-200 (Nippon Silica Industry Corp.), respectively, were used. The value of the alkali is indicated by conversion of the moles of the alkali that were actually used to moles of the alkali described by the formula $M_2O$ (M is an alkaline metal).

Next, four 3.0 g portions of each of the treatment agents (i.e., the aqueous emulsions mentioned above) were added to the four beakers and then the resulting mixtures were stirred until homogeneous. The beakers were placed in a hot oven, and heated at the temperature of 150° C. for 30 minutes.

TABLE 1

| | Silica particles (in terms of $SiO_2$) | | Alkali (in terms of $M_2O$) M:Alkaline metal) | | | |
|---|---|---|---|---|---|---|
| | Colloidal silica | Ultrafine-powdered silica | KOH | NaOH | LiOH | $K_2CO_3$ |
| a | 3.5 | 0 | 1 | 0 | 0 | 0 |
| b | 0 | 3.5 | 0 | 0 | 0 | 1 |
| c | 3.5/2 | 3.5/2 | 0.9 | 0.1 | 0 | 0 |
| d | 4 | 0 | 0.8 | 0.1 | 0.1 | 0 |

(B) Evaluation of surface-treated magnetic powder

Surface-treated magnetic powders Samples 1.1 to 1.4 obtained in section A: Samples 1.1 to 1.4 correspond to those prepared by treatment of the magnetic powder with the treatment agents a–d, respectively. They were evaluated by tests 1–4. Test 1: After the magnetic powder is heated to 400° C. in the air at the rate of increase of 5° C./minute, the rate of its weight increase (%) is measured (thermal weight analysis). Test 2: After separate portions of the magnetic powder are heated at the temperature of 250° C. or 350° C., the rate of the weight increase (%) of the two portions is measured. Test 3: After one volume of the magnetic powder is immersed into twenty volumes of tap water, the mixture is left for 30 days, and the formation of rust on the surfaces of the powder is observed. Rust formation was also looked for 2 hours after the mixing. Test 4: The magnetic powder is kept at the temperature of 80° C. in an atmosphere of 95% relative humidity. The rate of the weight increase (i.e., the moisture absorption rate (%)) is measured. The results of these tests are shown in Table 2. In Tables 2–5, the amount of the treatment agent is the percent by weight of the solid content therein to the weight of the magnetic powder.

(C) Evaluation of the magnetic properties of surface-treated magnetic powder

The surface-treated magnetic powders obtained in section A (Samples 1.1 to 1.4) were kept at the temperature of 80° C. in an atmosphere of 95% relative humidity for 7 days. The maximum energy products [(BH)max] of the magnetic powder before and after standing were measured and compared. The results of these tests are shown in Table 3.

COMPARATIVE EXAMPLE 1

(A) Preparation of surface-treated magnetic powder

Surface-treated magnetic powders were obtained by the procedure of Example 1 except that Water glass No. 1 [$SiO_2/Na_2O$ (molar ratio)=2.0], Water glass No. 3 [$SiO_2/Na_2O$ (molar ratio)=3.0], Water glass No. 4 [$SiO_2/Na_2O$ (molar ratio)=4.0], or potassium silicate [$SiO_2/K_2O$ (molar ratio)=3.4] were used, respectively, as the treatment agent in the form of a 10% solution (by weight, solid content) in water.

(B) Evaluation of surface-treated magnetic powder

The surface-treated magnetic powders obtained in section A of this Comparative Example (Samples 1.6 to 1.9, which were prepared by treatment of the magnetic powders with Water glass No. 1, No. 3, No. 4, and potassium silicate, respectively) were evaluated by the procedure of section B of Example 1. Also, as a control, the Magnequench (Samples 1.5) used in Example 1 was evaluated in the same way. The results are shown in Table 2.

(C) Evaluation of magnetic properties of surface-treated magnetic powder

The surface-treated magnetic powders obtained in section A of this comparative Example were evaluated by the procedure of section C of Example 1. Also, the Magnequench was evaluated in the same way. The results are shown in Table 3.

TABLE 2

| | Sample No. | Treatment agent Type | Treatment agent Amount (%) | Weight increase in thermal weight analysis (%) | 2 Weight increase at 250° C. (%) | 2 Weight increase at 350° C. (%) | 3 Generation of rust After 2 hours | 3 Generation of rust After 30 days | 4 Weight increase (%) | 4 Visual observation |
|---|---|---|---|---|---|---|---|---|---|---|
| Example 1 | 1.1 | A | 0.6 | 0.1 | <0.01 | 0.02 | Not changed | Not changed | 2 | Not changed |
| | 1.2 | B | 0.6 | 0.1 | <0.01 | 0.02 | Not changed | Not changed | 2 | Not changed |
| | 1.3 | C | 0.6 | 0.1 | <0.01 | 0.02 | Not changed | Not changed | 4 | Not changed |
| | 1.4 | D | 0.6 | 0.1 | <0.01 | 0.02 | Not changed | Not changed | 3 | Not changed |
| Comparative Example 1 | 1.5 | — | — | 7.2 | 0.8 | 4.2 | Water turned yellow | Red rust precipitated | 0 | Not changed |
| | 1.6 | Water glass No. 1 | 0.6 | 0.1 | <0.01 | 0.06 | Not changed | Not changed | 80 | Aggregation observed |
| | 1.7 | Water glass No. 3 | 0.6 | 0.1 | <0.01 | 0.05 | Not changed | Not changed | 70 | Aggregation observed |
| | 1.8 | Water glass No. 4 | 0.6 | 0.1 | <0.01 | 0.04 | Not changed | Not changed | 60 | Aggregation observed |
| | 1.9 | Potassium silicate | 0.6 | 0.1 | <0.01 | 0.07 | Not changed | Water turned yellow | 40 | Aggregation observed |

TABLE 3

| | Sample No. | Treatment agent Type | Treatment agent Amount | Maximum energy product (MGOe) Initial | Maximum energy product (MGOe) After 7 days | Decrease in maximum energy product (%) |
|---|---|---|---|---|---|---|
| Example 1 | 1.1 | a | 0.6 | 12.0 | 11.9 | 0.8 |
| | 1.2 | b | 0.6 | 12.0 | 11.8 | 1.7 |
| | 1.3 | c | 0.6 | 12.0 | 12.0 | 0 |
| | 1.4 | d | 0.6 | 12.0 | 12.0 | 0 |
| Comparative Example 1 | 1.5 | — | — | 12.0 | 8.2 | 31.7 |
| | 1.6 | Water glass No. 1 | 0.6 | 12.0 | 9.4 | 21.7 |
| | 1.7 | Water glass No. 3 | 0.6 | 12.0 | 9.6 | 20.0 |
| | 1.8 | Water glass No. 4 | 0.6 | 12.0 | 9.8 | 18.3 |
| | 1.9 | Potassium silicate | 0.6 | 12.0 | 10.2 | 15.0 |

As shown in Table 2, Magnequench (Samples 1.5) had a higher rate of weight gain by oxidation after being heated at high temperatures and there was generation of rust because of the presence of water. However, because the Magnequench was treated with a lubricant during its manufacture, the weight gain in Evaluation 4 was zero Samples 1.6 to 1.9, which were treated with treatment agents containing alkali silicate, had relatively low weight gains at high temperatures (Evaluations 1 and 2), but they aggregated when they were kept at high temperatures in high humidity because of their greater absorption of moisture (Evaluation 4). On the other hand, Samples 1.1 to 1.4, which were treated with treatment agents containing alkali-modified silica particles, had much lower weight gains at high temperatures and also less moisture absorption at high temperatures in high humidity. When these samples were immersed in water, no rust formed on their surfaces (Evaluation 3). Therefore, the coated layer formed by treatment of a magnetic powder with a treatment agent of this invention containing alkali-modified silica particles provides both excellent oxidation resistance and excellent rust preventing resistance.

As shown in Table 3, Magnequench (1.5) and Samples 1.6 to 1.9, which were treated with treatment agents containing alkali silicate, all had less magnetic force after being left in surroundings of high humidity. However the surface-treated magnetic powders of this invention, Samples 1.1 to 1.4, did not lose magnetic force.

EXAMPLE 2

The combination of 95% by weight of bisphenol-A-type epoxy resin and 5% by weight of 2-ethyl-4-methylimidazole as a curing agent was added to and mixed with the four kinds of surface-treated magnetic powders obtained in Example 1 at the proportion of 3% by weight. The mixtures were molded by compression molding, and cured at the temperature of 80° C. for 2 hours and then 150° C. for 1 hour to form resin-bonded permanent magnets. For the magnets obtained, the residual magnetic flux density, coercive force, and maximum energy product were measured by means of a direct-current automatic fluxmeter (TRF-5BH25Auto, Toei Industrial Corp.). Then, after these resin-bonded permanent magnets were kept at the temperature of 80° C. in 95% relative humidity for 500 hours, their residual magnetic flux density, coercive force, and maximum energy product were measured in the same way. The results of these measurements are shown in Table 4.

COMPARATIVE EXAMPLE 2

Resin-bonded permanent magnets were prepared and evaluated by the procedure of Example 2 except that the surface-treated magnetic powders obtained in Comparative Example 1 (Samples 1.6 to 1.9) were used. Also, as a control, another resin-bonded permanent magnet was prepared from the Magnequench (Sample 1.5) used in Example 1, and evaluated in the same way. The results are shown in Table 4.

TABLE 4

| | Sample No. | Treatment agent Type | Treatment agent Amount (%) | Magnetic properties of resin-bonded permanent magnet (initial): Residual magnetic flux density (KG) | Coercive force (KOe) | Maximum energy product (MGOe) | Magnetic properties of resin-bonded permanent magnet (after 500 hr): Residual magnetic flux density (KG) | Coercive force (KOe) | Maximum energy product (MGOe) |
|---|---|---|---|---|---|---|---|---|---|
| Example 2 | 1.1 | a | 0.6 | 6.5 | 5.5 | 9.0 | 6.3 | 5.3 | 8.8 |
| | 1.2 | b | 0.6 | 6.5 | 5.5 | 9.0 | 6.3 | 5.3 | 8.8 |
| | 1.3 | c | 0.6 | 6.5 | 5.5 | 9.0 | 6.3 | 5.3 | 8.8 |
| | 1.4 | d | 0.6 | 6.5 | 5.5 | 9.0 | 6.3 | 5.3 | 8.8 |
| Comparative Example 2 | 1.5 | — | — | 5.6 | 5.0 | 7.0 | Cracked after 48 hours (rust generated over the entire surface) | | |
| | 1.6 | Water glass No. 1 | 0.6 | 6.5 | 5.4 | 8.9 | Cracked after 96 hours | | |
| | 1.7 | Water glass No. 3 | 0.6 | 6.5 | 5.3 | 8.9 | Cracked after 44 hours | | |
| | 1.8 | Water glass No. 4 | 0.6 | 6.5 | 5.4 | 8.9 | Cracked after 92 hours | | |
| | 1.9 | Potassium silicate | 0.6 | 6.5 | 5.5 | 9.0 | Cracked after 40 hours (rust spots generated on the surface) | | |

As shown in Table 4, when the resin-bonded permanent magnet prepared from Magnequench was kept at a high temperature and high humidity, rust generation and cracking occurred, resulting in destruction of the magnet in a short time. Also, when resin-bonded permanent magnets prepared from the magnetic powder treated with the treatment agents containing alkali silicate such as the water glasses were kept in the same conditions for 40 to 96 hours, cracking or disintegration occurred because of swelling caused by moisture absorption. On the other hand, resin-bonded permanent magnets prepared from the surface-treated magnetic powder of this invention retained their magnetic force without rusting or swelling caused by moisture absorption even when kept at a high temperature and high humidity.

EXAMPLE 3

Magnequench was stirred in a blender. Ten percent by weight of an aqueous emulsion of the treatment agent d prepared in section A of Example 1 was added to the Magnequench in the blender so that the amount of solids of the aqueous emulsion added was 0.4% based on the weight of the Magnequench. After the mixture was stirred to homogeneity, it was heated at the temperature of 112° C. for 5 minutes and then 200° C. for 5 minutes. Then, a mixture of 90 parts by weight of the resulting surface-treated magnetic powder and 10 parts by weight of nylon 12 was heated and extruded at the temperature of 270° C. to form pellets. The pellets were put into a molding machine and molded by injection molding to form a resin-bonded permanent magnet. Then, the mixture remaining in the metal mold of the molding machine after the molding process was collected and molded again. After this recycling procedure was repeated ten times, the resin-bonded permanent magnet obtained was evaluated by the procedure of Example 2. The results are shown in Table 5.

COMPARATIVE EXAMPLE 3

A resin-bonded permanent magnet was prepared by the procedure of Example 3 except that the Magnequench of Example 3 was used without any of the treatments mentioned above. Also, another resin-bonded permanent magnet was prepared by the same recycling procedure of Example 3 except that untreated Magnequench was used The resin-bonded permanent magnets were evaluated by the procedure of Example 2. The results are shown in Table 5.

TABLE 5

| | Sample No. | Treatment agent Type | Treatment agent Amount (%) | Magnetic properties of initial resin-bonded permanent magnet (first molding): Residual magnetic flux density (KG) | Coercive force (KOe) | Maximum energy product (MGOe) | Magnetic properties of recycled resin-bonded permanent magnet (molded ten times): Residual magnetic flux density (KG) | Coercive force (KOe) | Maximum energy product (MGOe) |
|---|---|---|---|---|---|---|---|---|---|
| Example 3 | 3.1 | d | 0.4 | 5.0 | 4.7 | 6.0 | 4.8 | 4.5 | 5.5 |
| Comparative Example 3 | 3.2 | None | — | 4.6 | 4.3 | 5.0 | 2.6 | 2.4 | 2.8 |

As shown in Table 5, the resin-bonded permanent magnet prepared from the untreated Magnequench by the recycling procedure had its magnetic properties decreased because of the oxidation of the Magnequench at high temperatures during the recycling procedure. On the other hand, the resin-bonded permanent magnet prepared from the surface-treated magnetic powders of this invention retained its magnetic properties even after the recycling procedure.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A coated magnetic powder obtained by coating a magnetic powder made of an alloy that comprises a rare earth metal and iron with an agent containing alkali-modified silica particles obtained by reacting silica particles with a mean particle diameter of from 0.005 to 0.1 μm with an alkali to modify the surface portion of said silica particles by said alkali.

2. A coated magnetic powder according to claim 1, wherein said magnetic powder contains an alloy of the formula RxTyBz as a major component:

wherein R is at least one rare earth metal selected from the group consisting of neodymium, praseodymium, and misch metal; T is iron or a combination of iron and iron-group elements; B is boron; x, y, and z denote atomic percents of R, T, and B, respectively, and satisfy the relationships:

$$8 \leqq x \leqq 30,\ 2 \leqq z \leqq 20,\ y = 100 - x - z$$

3. A coated magnetic powder according to claim 1, wherein said alkali is potassium hydroxide.

4. A permanent magnetic composition comprising a coated magnetic powder of claim 1 and a binder.

5. The composition according to claim 4, wherein said magnetic powder contains an alloy of the formula RxTyBz as a major component:

wherein R is at least one rare earth metal selected from the group consisting of neodymium, praseodymium, and misch metal; T is iron or a combination of iron and iron-group elements; B is boron; x, y, and z denote atomic percents of R, T, and B, respectively, and satisfy the relationship:

$$8 \leqq x \leqq 30,\ 2 \leqq z \leqq 20,\ y = 100 - x - z$$

6. A composition according to claim 4, wherein said alkali is potassium hydroxide.

7. A composition according to claim 4, wherein said binder comprises a resin.

8. A composition according to claim 2, wherein said misch metal is a mixture consisting essentially of rare earth metals of the cerium group.

9. A composition according to claim 5, wherein said misch metal is a mixture consisting essentially of rare earth metals of the cerium group.

10. A composition according to claim 1, wherein said alkali-modified silica particles are obtained by preparing an aqueous emulsion containing silica particles and alkali, and heating said emulsion to modify a surface portion of said silica particles by said alkali.

11. A composition according to claim 10, wherein said aqueous emulsion is heated to a temperature from about 90° to about 100° C.

* * * * *